US008180240B2

(12) United States Patent
Cao et al.

(10) Patent No.: US 8,180,240 B2
(45) Date of Patent: May 15, 2012

(54) COLOR BELT FUSER WARM-UP TIME MINIMIZATION

(75) Inventors: Jichang Cao, Lexington, KY (US); James Douglas Gilmore, Lexington, KY (US); Hrishikesh Pramod Gogate, Lexington, KY (US); Wesley David McIntire, Lexington, KY (US); Calvin Dale Murphy, Lexington, KY (US); Thad Carlton Switzer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 851 days.

(21) Appl. No.: 12/050,483

(22) Filed: Mar. 18, 2008

(65) Prior Publication Data

US 2009/0238597 A1 Sep. 24, 2009

(51) Int. Cl.
*G03G 15/20* (2006.01)

(52) U.S. Cl. ..... 399/70

(58) Field of Classification Search ..... 399/67, 399/69, 70; 219/216
See application file for complete search history.

(56) References Cited

U.S. PATENT DOCUMENTS

| | | | | |
|---|---|---|---|---|
| 5,801,360 | A * | 9/1998 | Oba et al. | 219/216 |
| 7,235,761 | B1 | 6/2007 | Maul et al. | |
| 2003/0039492 | A1 * | 2/2003 | Hamada et al. | 399/329 |
| 2004/0188416 | A1 * | 9/2004 | Cao et al. | 219/492 |
| 2004/0218942 | A1 | 11/2004 | Gogate et al. | |
| 2004/0223777 | A1 | 11/2004 | Cao et al. | |
| 2005/0214013 | A1 | 9/2005 | Gilmore | |
| 2007/0047990 | A1 | 3/2007 | Lemaster et al. | |
| 2009/0139982 | A1 | 6/2009 | Cao et al. | |
| 2009/0142086 | A1 | 6/2009 | Cao et al. | |
| 2009/0245837 | A1 | 10/2009 | Campbell et al. | |
| 2009/0245838 | A1 | 10/2009 | Shuman et al. | |
| 2010/0014881 | A1 | 1/2010 | Cao et al. | |

* cited by examiner

*Primary Examiner* — David Gray
*Assistant Examiner* — Billy J Lactaoen

(57) ABSTRACT

A belt fuser assembly for a color EP printer that quickly warms up the fusing belt before allowing a first sheet of print media to run through the printing stations at the fuser assembly. The warm-up cycle includes: (1) a preheat mode, (2) a first portion of a belt temperature warm-up mode, (3) a second portion of the belt temperature warm-up mode, and (4) a tight belt temperature control mode. The preheat mode operates the fuser's heater at less than full power, and prevents the fuser belt from rotating. The first portion of the belt temperature warm-up mode operates the heater at full power, and the fuser belt begins rotating, but not at its full speed. The second portion of the belt temperature warm-up mode operates the heater at less than full power, and the fuser belt begins rotating at its full speed.

19 Claims, 7 Drawing Sheets

COLOR BELT FUSER WARM-UP TIME MINIMIZATION

BACKGROUND OF THE INVENTION

1. Field of the Invention

The present invention relates generally to image forming equipment and is particularly directed to electrophotographic (EP) printers of the type which use fusers to fix toner to print media, such as paper sheets. The invention is specifically disclosed as a belt fuser assembly for a color EP printer that quickly warms up the fusing belt before allowing a first sheet of print media to run through the fuser assembly. The warm-up cycle includes: (1) a preheat mode, (2) a first portion of a belt temperature warm-up mode, (3) a second portion of the belt temperature warm-up mode, and (4) a tight belt temperature control mode. Certain parameters are sensed or calculated before moving from one mode to the next.

In one embodiment, the preheat mode operates the fuser's heater at less than full power, and also prevents the fuser belt from rotating. During the first portion of the belt temperature warm-up mode, the heater operates at full power, and the fuser belt begins rotating, but not at its full speed. During the second portion of the belt temperature warm-up mode, the heater operates at less than full power (according to a temperature setpoint algorithm), and the fuser belt begins rotating at its full speed. During the tight belt temperature control mode, the fuser belt begins running at its "printing speed" if a print job is "ready," and the belt temperature is controlled rather tightly to remain within its proper fusing temperature tolerance.

The temperature setpoint used for controlling the heater's temperature is varied, according to the control mode. During the preheat mode, the setpoint is started at one value (e.g., 120° C.), and during the full power portion of the belt temperature warm-up mode the setpoint is raised to a greater value (e.g., 240° C.), to force the fuser system to quickly increase in temperature. The temperature of the belt is not directly sensed in the illustrated embodiment, and it is instead inferred from a temperature sensor at the heater itself, and from calculating the AC line voltage that is powering the fuser's heater element by how quickly the heater rises in temperature during the early steps of the warm-up process.

2. Description of the Related Art

Two of the most important issues when using a belt fuser for a color laser printer are the possibility of the heater element cracking and also the amount of the warm-up time required before the first print can be made. To reduce the fuser's warm-up time, the heating power needs to be as high as possible. However, excessive heating power can crack the heating element. One way to prevent the heater from cracking is to limit the heater temperature ramping rate during the fuser warm-up, and that is used in many monochrome belt fusers. Unfortunately by limiting the temperature ramp-up rate, this also increases the fuser's warm-up time.

The fusing belt of color electrophotographic (EP) fusers typically has a larger thermal mass as compared to fusing belts used for monochrome EP printers. In addition, some of the newer color EP printers have a larger backup roll. All of these factors make the color belt fuser warm-up much slower than that of a monochrome belt fuser. To decrease the amount of time required before the first printed copy is made, a new fuser warm-up algorithm is needed that can minimize the fuser warm-up time while not cracking the heater element.

SUMMARY OF THE INVENTION

Accordingly, it is an advantage of the present invention to provide an image forming apparatus such as a color electrophotographic (EP) printer which includes a belt fuser assembly that quickly warms up the fusing belt before allowing a first sheet of print media to run through the fuser assembly, in which a warm-up cycle includes: (1) a preheat mode, (2) a first portion of a belt temperature warm-up mode, (3) a second portion of the belt temperature warm-up mode, and (4) a tight belt temperature control mode.

It is another advantage of the present invention to provide a belt fuser assembly for a color electrophotographic (EP) printer that has a preheat mode which operates the fuser's heater at less than full power, and also prevents the fuser belt from rotating; a first portion of a belt temperature warm-up mode, in which the heater operates at full power, and the fuser belt begins rotating, but not at its full speed; a second portion of the belt temperature warm-up mode, in which the heater operates at less than full power (according to a temperature setpoint algorithm), and the fuser belt begins rotating at its full speed; and a tight belt temperature control mode, in which the fuser belt begins running at its "printing speed" if a print job is "ready," while the belt temperature is controlled rather tightly to remain within its proper fusing temperature tolerance.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a belt fuser assembly for an electrophotographic printer is provided, which comprises: (a) an endless fuser belt that rotates; (b) a heater for heating the fuser belt; (c) a backup member that engages the fuser belt and defines a fusing nip with the fuser belt; (d) a controller that provides a first signal for energizing the heater, and provides a second signal for rotating the fuser belt; (e) wherein the controller is configured to warm up the fuser belt before allowing the fuser assembly to perform a printing function, using the following routines: (i) a preheat mode; (ii) a first portion of a belt temperature warm-up mode; (iii) a second portion of the belt temperature warm-up mode; and (iv) a tight belt temperature control mode; (f) wherein during the preheat mode, the first signal energizes the heater such that the heater operates at less than full power, and the second signal prevents the fuser belt from rotating; (g) wherein during the first portion of the belt temperature warm-up mode, the first signal energizes the heater such that the heater operates at full power, and the second signal rotates the fuser belt at a first rotational speed; and (h) wherein during the second portion of the belt temperature warm-up mode, the first signal energizes the heater such that the heater operates at less than full power, and the second signal rotates the fuser belt at a second rotational speed that is greater than the first rotational speed.

In accordance with another aspect of the present invention, a belt fuser assembly for an electrophotographic printer is provided, which comprises: (a) an endless fuser belt that rotates; (b) a heater for heating the fuser belt; (c) a backup member that engages the fuser belt and defines a fusing nip with the fuser belt; (d) a controller that provides a first signal for energizing the heater, and provides a second signal for rotating the fuser belt; (e) a temperature sensor that is located proximal to the heater; (f) wherein the controller is configured to warm up the fuser belt before allowing the fuser assembly to perform a printing function, using the following routines: (i) a preheat mode; (ii) a belt temperature warm-up mode; and (iii) a tight belt temperature control mode; (g) wherein during the preheat mode, the first signal energizes the heater such that the heater operates at less than full power, in which the first signal operates using a first predetermined temperature setpoint value; (h) wherein during the belt temperature warm-up mode, the first signal continues to energize the heater as desired by the controller, in which the first signal operates using a second predetermined temperature setpoint value, wherein the second predetermined temperature setpoint value is greater than the first predetermined temperature setpoint value; and (i) wherein during the tight belt temperature control mode, the first signal continues to energize the heater as desired by the controller, in which the first signal operates using a third predetermined temperature setpoint value, wherein the third predetermined temperature setpoint value is less than the second predetermined temperature setpoint value.

In accordance with yet another aspect of the present invention, a belt fuser assembly for an electrophotographic printer is provided, which comprises: (a) an endless fuser belt that rotates; (b) a heater for heating the fuser belt; (c) a backup member that engages the fuser belt and defines a fusing nip with the fuser belt; (d) a controller that provides a first signal for energizing the heater, and provides a second signal for rotating the fuser belt; (e) a temperature sensor that is located proximal to the heater; (f) wherein the controller is configured to warm up the fuser belt before allowing the fuser assembly to perform a printing function, using the following routines: (i) check for a warm start mode by examining a temperature of the heater; (ii) if in a cold start mode: (A) set a heater power magnitude to less than full power; (B) monitor the heater temperature until it reaches a first value; and (C) after reaching the first value, switch to the warm start mode; and (iii) if in warm start mode: (A) turn on a motor for the fuser belt at about half speed; (B) increase the heater power to full power; (C) monitor the heater temperature until it reaches a second value; (D) after reaching the second value, switch fuser belt to full speed; (E) control the heater power at less than full power; (F) determine a time interval for operating in low power heating mode; (G) monitor elapsed time until it reaches the time interval; and (H) if print job is ready, control heater power to its printing value.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings. The accompanying drawings incorporated in and forming a part of the specification illustrate several aspects of the present invention, and together with the description and claims serve to explain the principles of the invention. In the drawings:

FIG. 3 also shows the power signal applied to the heating element versus time.

DETAILED DESCRIPTION OF THE INVENTION

Reference will now be made in detail to the present preferred embodiment of the invention, an example of which is illustrated in the accompanying drawings, wherein like numerals indicate the same elements throughout the views. The exemplification(s) set out herein illustrate(s) at least one preferred embodiment of the invention, in at least one form, and such exemplification(s) (is)(are) not to be construed as limiting the scope of the invention in any manner.

The terms "first" and "second" preceding an element name, e.g., first signal, second signal, etc., or first rotational speed, second rotational speed, etc. are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Figure 1:
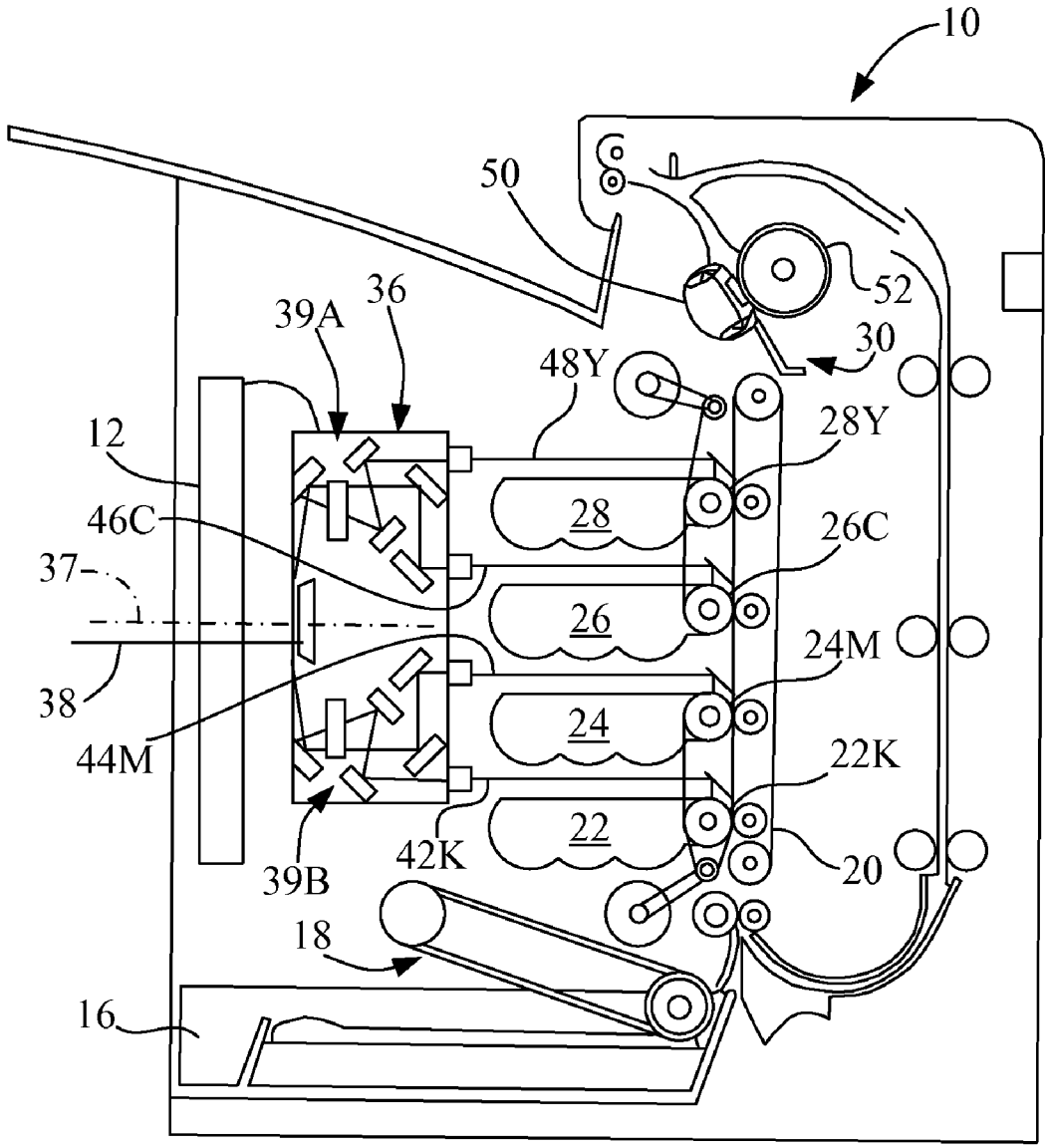
FIG. 1 is a diagrammatic view of an electrophotographic printer with multiple printing stations which includes a fuser assembly that is constructed in accordance with the principles of the present invention.

Referring now to the drawings, FIG. 1 depicts an electrophotographic image forming apparatus comprising a color laser printer, which is indicated generally by the numeral 10. An image to be printed is electronically transmitted to a print engine processor or controller 12 by an external device (not shown) or may comprise an image stored in a memory of the controller 12. The controller 12 includes system memory, one or more processors, and other logic necessary to control the functions of electrophotographic imaging, substrate transport, and fusing.

In performing a print operation, the controller 12 initiates an imaging operation where a top substrate (e.g., a paper sheet) of a stack of print media is picked up from a media tray 16 by a pick mechanism 18 and is delivered to a media transport belt 20. The media transport belt 20 carries the substrate passed each of four image forming stations 22, 24, 26, 28, which apply toner to the substrate. The image forming station 22 includes a photoconductive drum 22K that delivers black toner to the substrate in a pattern corresponding to a black (K) image plane of the image being printed. The image forming station 24 includes a photoconductive drum 24M that delivers magenta toner to the substrate in a pattern corresponding to the magenta (M) image plane of the image being printed. The image forming station 26 includes a photoconductive drum 26C that delivers cyan toner to the substrate in a pattern corresponding to the cyan (C) image plane of the image being printed. And the image forming station 28 includes a photoconductive drum 28Y that delivers yellow toner to the substrate in a pattern corresponding to the yellow (Y) image plane of the image being printed. The controller 12 regulates the speed of the media transport belt 20, media pick timing, and the timing of the image forming stations 22, 24, 26, 28 to effect proper registration and alignment of the different image planes to the substrate.

To effect the imaging operation, the controller 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A, 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C, 28Y by select lenses and mirrors in the post-scan optical systems 39A, 39B.

The media transport belt 20 then carries the substrate with the unfused toner image planes superposed thereon to a fuser assembly 30. The fuser assembly 30 may comprise a heater assembly 50 defining a heat transfer member and a backup roller 52 defining a pressure member cooperating with the heater assembly 50 to define a fusing nip 53 (see FIG. 2) through which substrates are conveyed. The backup roller 52 includes a outer TEFLON® sleeve 56 and an inner support roller 54 typically made of a foam-like material.

Figure 2:
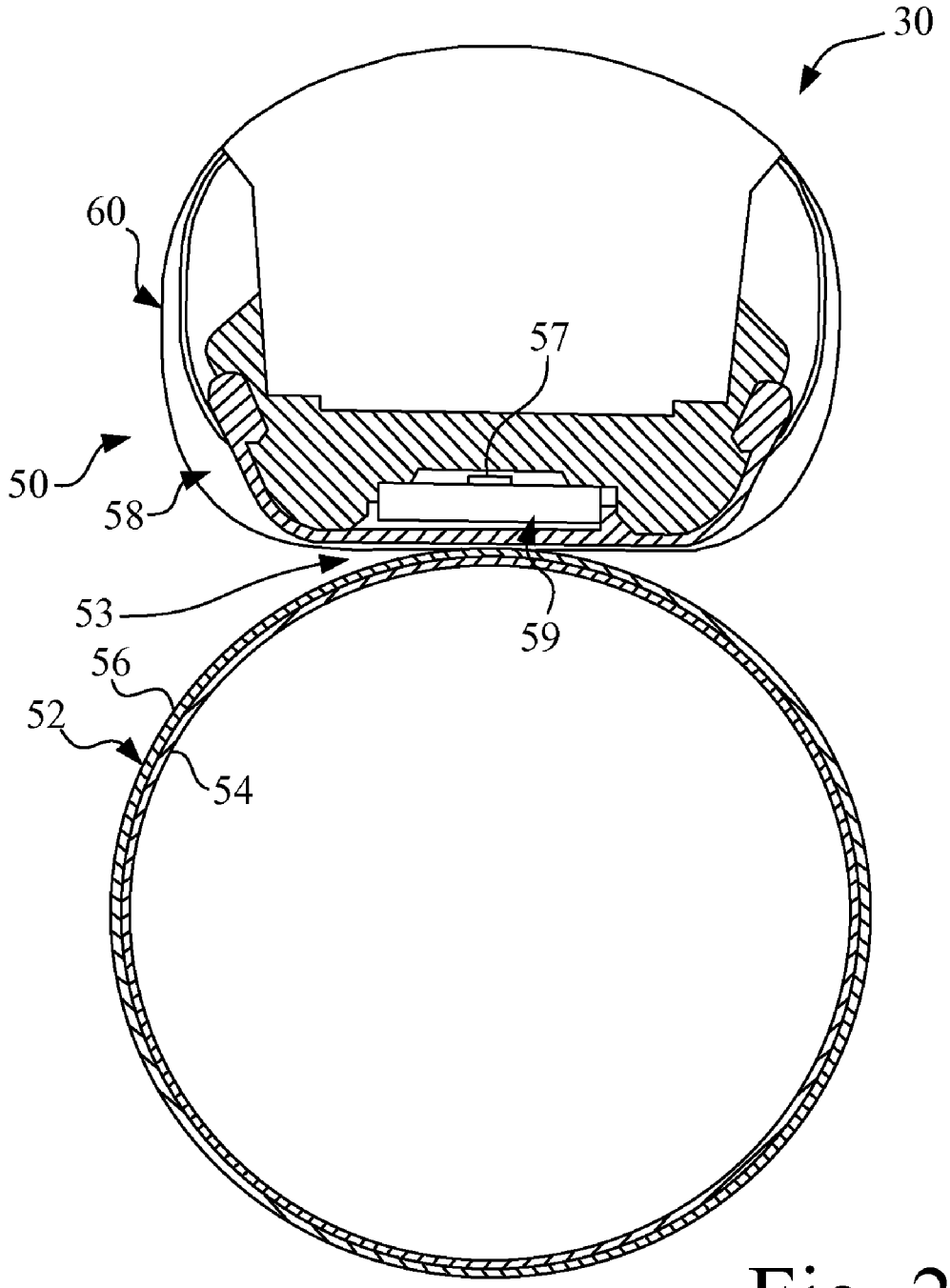
FIG. 2 is a side view, partially in cross-section, of the fuser assembly of the color EP printer of FIG. 1.

As shown in FIG. 2, the heater assembly 50 may comprise a housing structure 58 defining a support member, a heater element 59 supported on the housing structure 58, and an endless fuser belt 60 positioned about the housing structure 58. A temperature sensor 57, such as a thermistor, is positioned proximal to said heater element 59. On FIG. 2, temperature sensor 57 is coupled to a first surface of the heater element 59 that is opposite a second (heater) surface which is in contact with the belt 60. For additional details regarding an exemplary fuser assembly 30, reference can be made to U.S. Pat. No. 7,235,761, which is assigned Lexmark International, Inc., and is incorporated herein by reference.

AC line voltage can vary from around 90 volts to around 254 volts depending on where in the world one is using the commercially available AC power. Such a large line voltage range can result in large differences in heating power applied to a fuser of an imaging device unless proper power control is provided. For example, the heating power applied to a fuser heater element rated at 1200 watts at 115 volts varies from about 730 watts at 90 volts to about 5610 watts at 254 volts. In one mode of the invention, the fuser heater element 59 is a ceramic heater intended for use at a nominal supply voltage of 115 volts AC and might crack when a printer including the fuser is plugged into an AC outlet with line voltage above 130 volts if the power is not controlled properly to protect the heater element. The risk of cracking heater elements with excessive power at high line voltage is increased for double or triple sheet feeds during printing.

To minimize the fuser warm-up time, the amount of heat applied to the color belt fuser needs to be maximized within certain constraints. A primary concern is to prevent the heating element from cracking, and therefore the amount of heating power that is allowed for different operating modes needs to be determined so as to minimize the warm-up time, but also prevent the heater from cracking. For a particular model of color EP printer manufactured by Lexmark International, Inc., multiple tests have been performed at different voltage inputs to determine how much power is produced, and what the heating rate would be at those voltage input values. TABLE #1, below, shows the results of some of these tests:

TABLE #1

Table 1: Heating Power vs. Heating Rate when Belt is at Stationary

| AC Line Voltage (V) | Power (W) | Heating Rate (° C./sec) |
|---|---|---|
| 90 | 715 | 42.614 |
| 95 | 792 | 47.319 |
| 100 | 877 | 52.265 |
| 105 | 961 | 56.285 |
| 110 | 1054 | 60.484 |
| 115 | 1146 | 65.359 |
| 120 | 1254 | 70.258 |
| 125 | 1354 | 74.813 |
| 130 | 1467 | 78.329 |
| 135 | Heater Cracked========== | |

The data illustrated in TABLE #1 depicts the heating power versus the heating rate increase when the fuser belt is stationary and its motor is not turning. As can be seen, once the voltage reached a certain magnitude (e.g., 135 volts AC) the heater element cracked. Further testing was then performed to determine the heating rate when the fuser belt is rotating, and this information is provided below in TABLE #2:

TABLE #2

Table 2: Heating Power vs. Heating Rate when Belt is in Rotation

| AC Line Voltage (V) | Heating Power (W) | Heating Rate of Heater (° C./Sec) |
|---|---|---|
| 100 V | 890 | 14.5 |
| 110 V | 1020 | 19.4 |
| 115 V | 1150 | 21.94 |
| 120 V | 1270 | 24.71 |
| 130 V | 1490 | 30.71 |
| 137 V | 1640 | 35.83 |
| 140 V | 1720 | 37.1 |

In the present invention, the warm-up process for a color belt fuser is divided into three portions: (1) a heater "preheat" mode; (2) "belt temperature warm-up" mode; and (3) "tight belt temperature control" mode.

The preheat mode is used to reduce the viscosity of the grease in the components by warming the heater up to a predetermined temperature (such as 120° C.) before rotating the belt, so that a low cost motor can be used in the printer. During the preheat mode, certain algorithms can be performed to check for excessive wattage and also perform an estimation of the available heating power (which is related to the AC line voltage magnitude and other part variations). When the heater temperature reaches the predetermined value (e.g., 120° C.), the preheat process finishes, and the warm-up process switches to the "belt temperature warm-up" mode.

During the belt temperature warm-up mode, the fuser belt begins to rotate, the heating power that is applied to the heating element 59 changes from the preheat power level to full power. In addition, the heater setpoint is raised to a higher value, such as being raised from 120° C. in the preheat mode to 240° C. in the belt temperature warm-up mode. When the heater temperature reaches the higher setpoint value (e.g., 240° C.), the belt temperature warm-up mode is complete. The warm-up process now changes to the "tight belt temperature control" mode.

During the tight temperature control mode, the heater setpoint is properly adjusted to attempt to eliminate belt temperature overshoots and undershoots, and also to ensure that the belt temperature is within the fusing operating window and ready to print at the proper times. If the fusing temperature operating window has a tolerance of ±10° C., then the temperature control truly needs to be relatively "tight." In one model of a color EP printer made by Lexmark International, Inc., the operating temperature window for the color belt EP printer is from 160° C. to 180° C.

Figure 3:
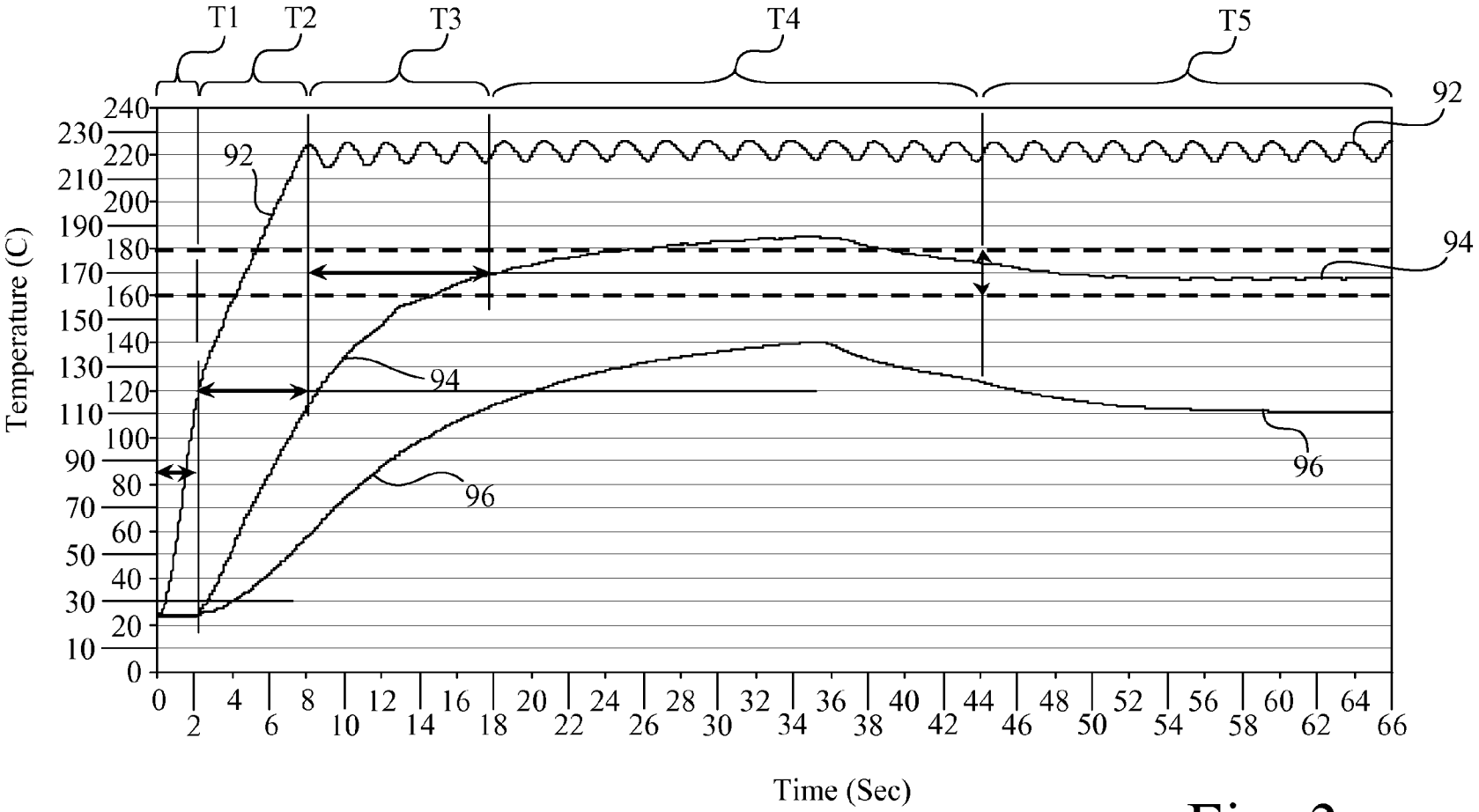
FIG. 3 is a graph showing the temperature of certain components of a color EP printer, in which temperature is along the Y-axis, and in which time is along the X-axis.

Referring now to FIG. 3, much of the temperature information and energy control information is provided in graphical form, and this graph will now be briefly discussed. A gating signal to a triac is used to control the current through the fuser's heater element. In this manner, the power through the heater element is switched on or off as according to the temperature control algorithm. There are five time intervals on FIG. 3 that are important to the present invention. The first interval is referred to as T1 on the graph, and this is the preheat mode time period. The next interval is referred to as T2, and this is the high power portion of the "belt temperature warm-up" mode of operation. The next interval is referred to as T3, and this is the low power portion of the "belt temperature warm-up" mode of operation. The next interval is referred to as T4, and this is the beginning of the "tight belt temperature control" mode, and will likely include a certain amount of time where the belt temperature will overshoot to a small extent. The final interval is referred to as T5, and this is the interval during which most of the printing operations will take place, when the temperature of the fuser belt remains within the operating window of the fusing temperature that is considered nominal.

On FIG. 3, the curve indicated by the reference numeral 92 is the heater temperature. The curve indicated by the reference numeral 94 is the temperature of the fuser belt. The curve indicated by the reference numeral 96 is referred to as the "BUR temperature" which stands for the back-up roller temperature.

Preheat Mode

As noted above, to reduce grease viscosity, the heater must be warmed up to a certain minimum temperature before rotating the fuser's belt. In certain models of color EP printers manufactured by Lexmark International, Inc., the minimum warm-up temperature is 120° C. Care must be taken to not allow the heater to be energized at full power for more than a certain amount of time in order to prevent heater crack and excessive thermal shock. In certain monochrome belt fusers, the heater is warmed up at a predetermined ramp-up rate for all possible AC line voltages by cycling the heater on and off during the warm-up mode. For certain color EP fusers, however, the print engine does not "fix" the heater ramp-up rate; instead, the ramp-up rate is increased or decreased according to variations in the AC line voltage, because the print engine needs to use the resulting ramp rate variation to estimate the heating power that should be applied.

Since a color belt fuser has a relatively small fusing operating window (about 20° C.), the heating power needs to be kept at a relatively constant power level, such as 800 watts, for all possible AC line voltages, to thereby achieve "tight" control of the belt temperature. To accomplish this, the print engine estimates the actual heating power being produced by monitoring the ramp-up rate of the heater temperature when the printer is turned on. A pulse width modulation (PWM) control algorithm can deliver the 800 watts heating power by adjusting the duty cycle of the AC sine wave, based on the estimated heating power. Details of this type of heating power estimation are described in U.S. patent application Ser. No. 11/946,948, filed on Nov. 29, 2007, titled "HEATING POWER ESTIMATION," which is assigned to Lexmark International, Inc., and is incorporated by reference herein. It should be noted that the temperature control algorithm is not restricted to PWM control. Instead, the control could be phase control or any other type of control known by one skilled in the art.

In the present invention, the color belt fuser prevents heater crack by limiting the maximum heating power during the preheat mode to reduce excessive thermal shock. In one mode of the invention, the maximum heating power that is allowed during the preheat mode is 1354 watts. To ensure that the heater will not crack, and in case a 115 volt AC fuser is put into a 230 volt printer by mistake, the power control duty cycle can be set at 30% during the preheat mode. For example, the heater could operate for three AC full cycles in the energized state, and then for seven AC full cycles in the de-energized state, for each ten AC full cycles during the preheat mode. A more preferred method is to use phase angle control of the AC sine waves, for determining the heater's power duty cycle. At this point in the control scheme, a 30% duty cycle will prevent heater crack for all possible operating conditions (for particular models of color EP printers made by Lexmark International, Inc.).

Some further details of the preheat mode are presented below as part of an exemplary algorithm that may be used with the present invention:

Preheat Algorithm:

- Turn off fuser motor.
- Set heater set-point @120° C.
- Set heating power level at 30 percent of full power to prevent heater crack.
  - At every zero crossing of AC voltage, reset PHASE_TIMER=0 and start to count time.
  - When the time saved in PHASE_TIMER is equal to or greater than PHASE_DELAY, set heater on signal high to turn on heater.
- Monitor heater temperature.
- If heater temperature<50° C., perform
  - EWC check
  - Heating power estimation
- If heater is equal to or greater than 120° C., switch warm-up process from preheat to belt temperature warm up.

Belt Temperature Warm-Up Mode

Once the preheat mode has completed, the torque should be reduced to a level acceptable when using a low cost motor, and the fuser belt now begins to rotate. The printer is now in the belt temperature warm-up mode, and this process can be divided into a "high power heating portion" and a "low power heating portion." This corresponds to the intervals T2 and T3 on FIG. 3.

The high power heating portion of the belt temperature warm-up mode continues from the time that the belt begins to rotate to the time that the heater reaches its setpoint temperature. On FIG. 3, the setpoint temperature is around 225° C. for the heater. The low power heating portion of the belt temperature warm-up mode occurs from the time when the heater reaches its setpoint temperature to the time that the fuser belt reaches its fusing temperature, which in FIG. 3 is at about 178° C. During the high power portion (interval T2), the heater power is continuously on and thereby quickly heats the belt with its full power that is available. After the heater temperature reaches its setpoint, the heating process switches from full power heating to "low power heating" in which the heater is not continuously energized, and instead the heater power is cycled on and off to bring the heater temperature close to its setpoint value, without significant temperature overshoot. This corresponds to the interval T3 on FIG. 3.

During the low power heating portion (interval T3), the heating power is controlled so as to be significantly lower than full power, effectively about only one-fourth of full power.

The belt temperature response at the low power heating portion thus is significantly slower than the belt temperature response during the higher power heating portion (interval T2). Moreover, another important factor that affects the warm-up time of the fuser belt is the rotation speed. Increasing rotation speed of the fuser belt tends to reduce the warm-up time of the belt.

Figure 4:
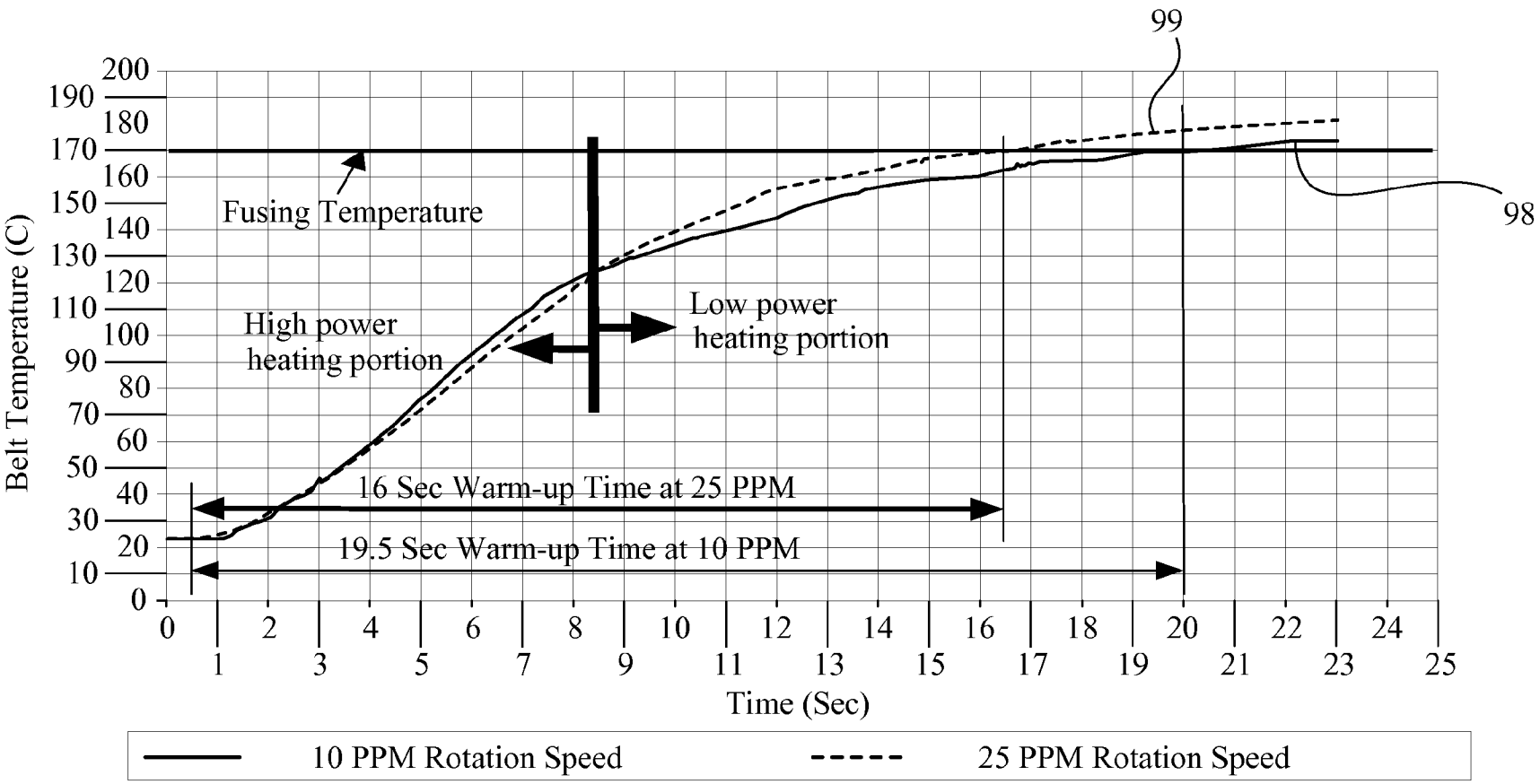
FIG. 4 is a graph of belt temperature versus time during warm-up at different rotation speeds of the fuser belt.

For a particular model of color EP belt fuser, and using the same heater setpoints, a test was performed to determine the warm-up time of the belt versus a rotation speed of that belt. The test results showed that if the rotation speed was equivalent to 10 pages per minute (PPM), the warm-up time was 19.5 seconds; if the belt speed was equivalent to 25 PPM, the warm-up time was only 16 seconds. FIG. 4 shows a graphical representation of this test.

The results indicated in FIG. 4 also show that the rotation speed of the fuser belt 60 has different effects on the belt temperature response during different portions of the belt warm-up process. During the high power heating portion (interval T2), the heater is continuously turned on with full power for both speeds. When the belt 60 is rotated at the higher speed, it loses more heat by conducting further heat to the backup roll. Therefore, the belt temperature response at 25 PPM rotation speed is somewhat slower than the belt temperature response at 10 PPM rotation speed. During the low power heating portion (interval T3), the heater 59 is controlled to be turned on and off to maintain the heater temperature around its setpoint. The heating power level depends on the thermal load, which relates to the rotation speed. A high rotation speed will generate a higher thermal load, and the higher thermal load requires the heater to provide more heating power to maintain the heater temperature around its setpoint. Since the higher rotating speed can draw more thermal energy from the heater, the belt temperature response at 25 PPM speed is significantly faster than at the 10 PPM speed.

The warm-up time of the belt can be minimized by first maximizing the amount of time during the high power heating portion, which also can allow the amount of time during the low power heating portion to be reduced. One important parameter that affects the on-time period of the high power heating portion is the heater setpoint value. Because the heating power is reduced only after the heater temperature reaches a setpoint, a higher setpoint requires a longer time for the heater 59 to reach its setpoint and the time period of the high heating power can be increased, thereby reducing the overall belt warm-up time. The setpoint can be set as high as possible based upon the materials used for the heater housing 58 and for the grease. In one model of a color belt EP fuser made by Lexmark International, Inc., the heater setpoint during the warm-up period can be as high as 240° C.

Another factor is the nip pressure between the fuser belt 60 and the back-up roller 52. This is also referred to as the "fusing nip" 53. Increasing the nip pressure will reduce thermal contact resistance between the heater and the fuser belt, which will increase the amount of heat transferred from the heater to the belt. This will also increase the belt temperature response, and also will tend to slow the heater temperature response during the warm-up interval. Therefore, the heater 59 will take a longer time to reach its setpoint, and this allows an increase of the amount of time that the high power heating portion can be used (interval T2), which should reduce the overall belt warm-up time.

As noted above, adjusting the rotation speed of the belt 60 can reduce the warm-up time of that belt. The information on FIG. 4 indicates that the fuser belt should be rotated at lower speeds during the high power heating portion (interval T2), but then once the heater temperature reaches its setpoint and the warm-up process switches from high power heating to low power heating, the rotation speed of the belt should be immediately increased to the full speed of the printer. This will raise the overall heating power level by increasing the thermal load.

Another factor is to maximize the heating power, which can allow up to 1720 watts of power without cracking the heating element 59 if the belt 60 is rotating. This information is given in TABLE #2. The actual heating power depends on the AC line voltage in these examples. At all voltage levels, the heater should be turned on with full power during the belt temperature warm-up period for the high power portion (interval T2).

As discussed above, the time interval for the low power heating portion (interval T3) is defined as the time from when the heater temperature reaches its setpoint to the time that the belt temperature reaches its fusing operating temperature. However, in the illustrated embodiment for the present invention there is no temperature sensor to monitor the actual belt temperature. Therefore, the print engine does not know precisely when the fusing belt has reached its fusing temperature and when the fuser is ready to print. This time interval instead is calculated based on printing speed, heater setpoint, and a heating power estimation that varies with the AC line voltage conditions. Based on these parameters, a calculation is performed during the pre-heating process. Once the result is known, a corresponding time interval value for the low power heating portion can be retrieved from a look-up table that was saved in flash memory or in some other type of memory device (such as an EEPROM). In other words, a tabular value can be read from memory based on predetermined ranges of numeric values from the heating power estimation calculation. After the heater temperature reaches its setpoint (and there is a temperature sensor to detect that), a timer is started. When that timer reaches the predetermined value that is read from the look-up table stored in memory, the warm-up process of the fuser has finished, and the fuser is ready to print.

As an alternative methodology, the time interval for the low power heating portion can be based on the magnitude of the temperature rise of the heater and the printing speed. The actual temperature rise will vary with the AC line voltage conditions, so this is an accurate measure of the electrical input power being received by the heater 59.

Once the fuser is ready to print, the controller must determine whether or not a print job is actually ready (available) for printing, or if the printer is still waiting for a print job to arrive. After finishing the warm-up process, if the print job is ready to print, the heater setpoint is immediately reset to the appropriate value for actual printing. This setpoint could be at 220° C., such as in the example illustrated on the graph of FIG. 3. On the other hand, if the printer is still waiting for a print job, the heater setpoint should be set to "idle," once the fuser's heater has finished the warm-up process. This will tend to eliminate temperature overshoot of the fuser belt. Details of how an exemplary heater setpoint control algorithm functions can be found in U.S. patent application Ser. No. 11/948,077, filed on Nov. 30, 2007, with the title "FUSER ASSEMBLY HEATER SETPOINT CONTROL," which is assigned to Lexmark International, Inc., and incorporated by reference herein.

Figure 5:
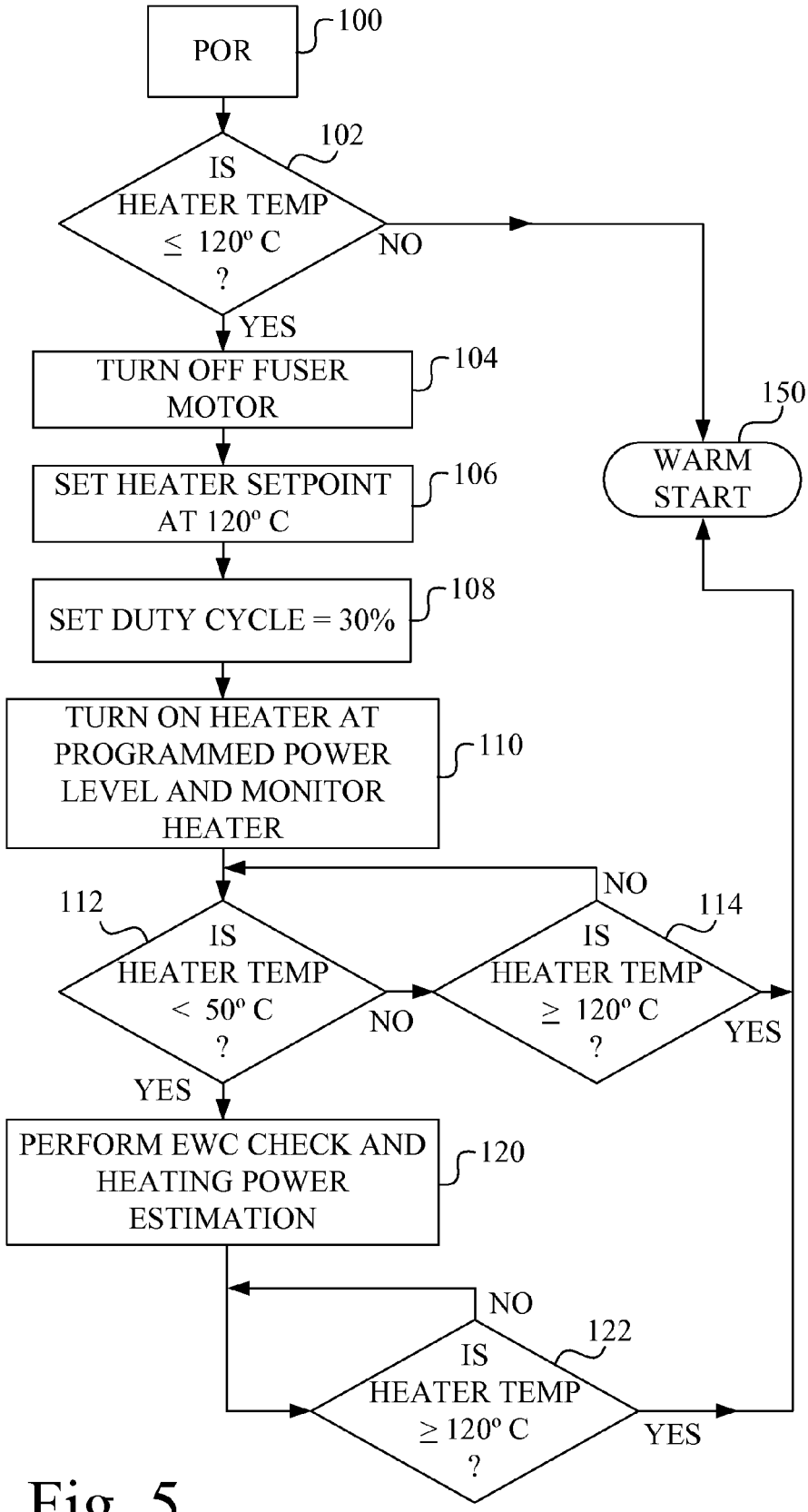
FIG. 5 is a flow chart of some of the important steps for controlling the heater of a color EP printer's fuser, as according to the principles of the present invention.

Referring now to FIG. 5, a flow chart shows some of the important steps used in the logic control of the present invention. Starting at a step 100, the system executes a power on reset function. A decision step 102 is performed next, which determines whether or not the heater temperature is less than or equal to 120° C. If the answer is NO, then the system determines that a "warm start" is occurring, and the logic flow is directed to a step 150, which then directs the logic flow to FIG. 6. At step 102, if the heater temperature is less than or equal to 120° C., then a step 104 turns OFF the fuser motor, and a step 106 sets the heater setpoint to 120° C.

A step 108 now sets the power level to 30%. A step 110 turns the heater ON (at 30% of full power), and the system now monitors the heater temperature.

A decision step 112 now determines if the heated temperature is less than 50° C. If the result is NO, then a decision step 114 determines if the heater temperature is greater than or equal to 120° C. If the result is YES, then the logic flow is directed to the "warm start" step 150. If not, the logic flow is directed back to decision step 112 where it continues to loop until the heater temperature is determined to be less than 50° C. If the result is YES, a step 120 performs an excessive wattage check ("EWC"), in which a heating power estimation is performed.

A decision step 122 now determines whether or not the heater temperature is greater than or equal to 120° C. If the result is NO, then the logic flow is directed back to the input of that same step in a logic loop. Once the result becomes YES, the logic flow is directed to the "warm start" step 150. The logic flow now continues on FIG. 6.

Figure 6A:
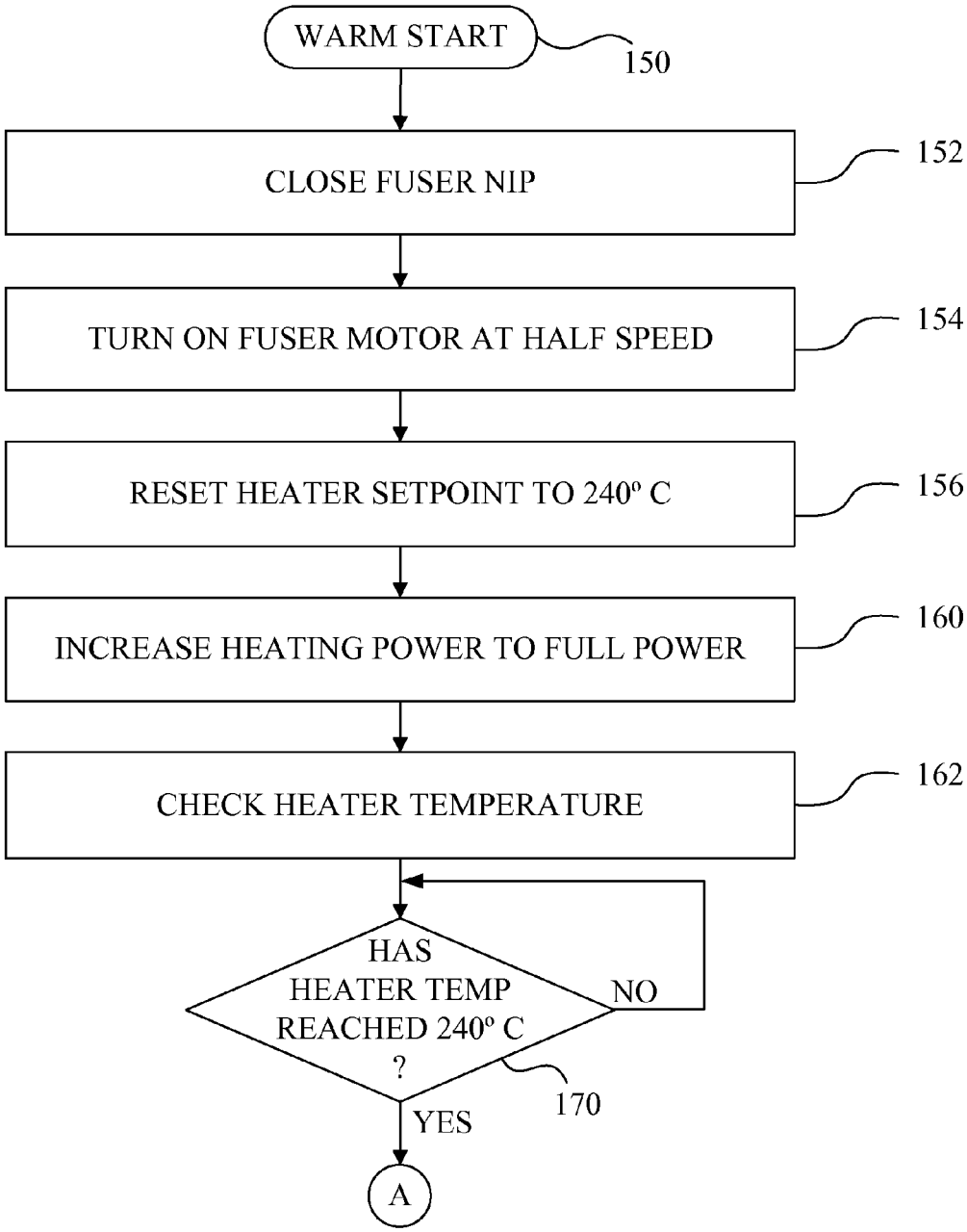
FIG. 6 is a flow chart of some of the important steps for controlling the heater of a color EP printer's fuser, assuming the fuser is starting at a "warm start" condition.
Figure 6B:
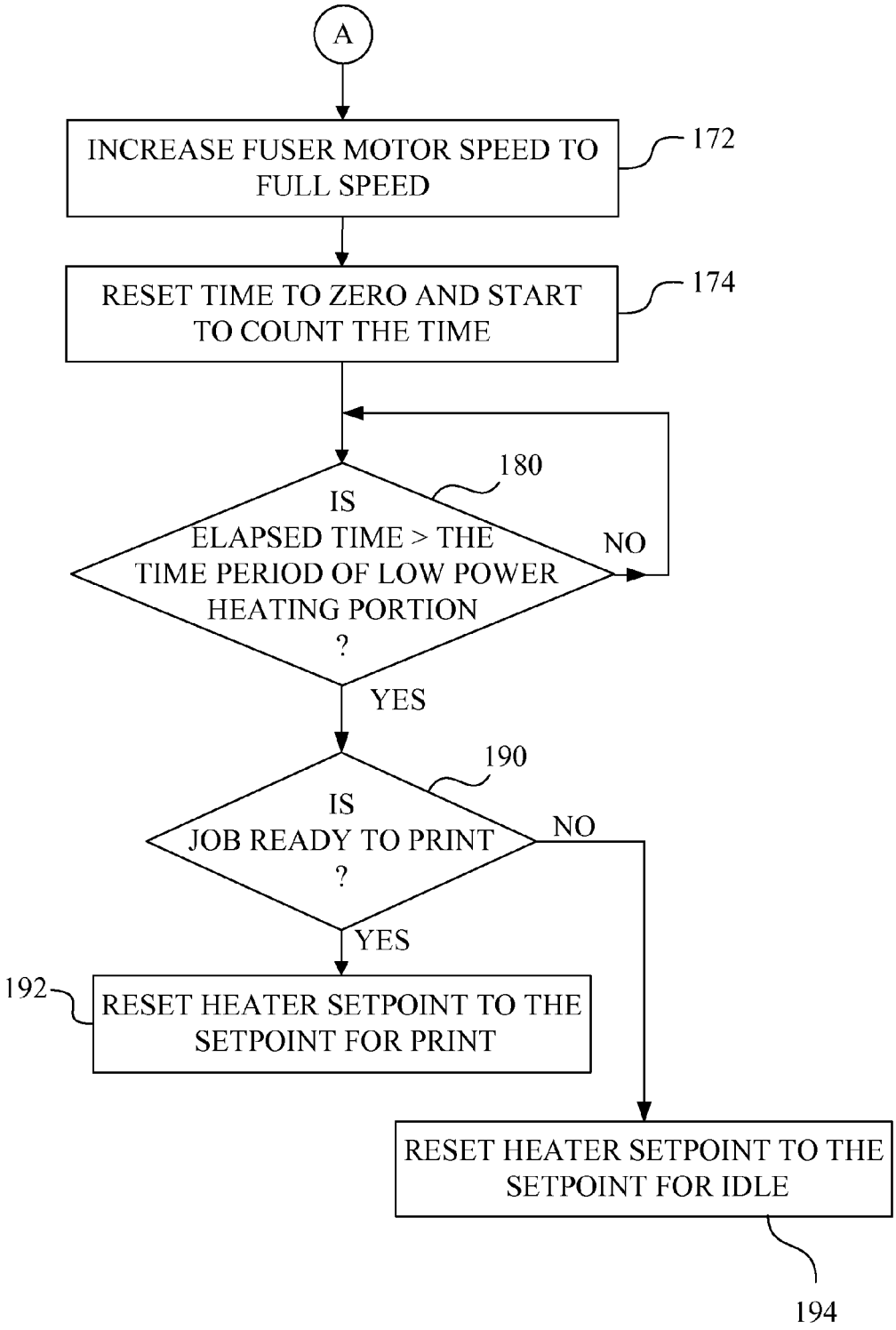

On FIG. 6, the "warm start" step 150 leads to a step 152 in which the fuser nip is closed. A step 154 turns on the fuser motor at half speed. This begins to rotate the fuser belt. A step 156 resets the heater setpoint to 240° C., and a step 160 increases the heating power to full power. When the heating power is increased to full power, on a 230 volt machine the PWM power control duty cycle is set to 100% to deliver full heating power. On a 115 volt machine, the phase delay attribute is reset so that the heater is turned on at zero crossing of the AC sine wave, to achieve full power. This portion of the flow chart essentially shows the steps taken at the beginning of the interval T2 of FIG. 3, which is the high power portion of the belt temperature warm-up mode.

A step 162 now checks the heater temperature, and a decision step 170 determines whether or not the heater temperature has reached the 240° C. setpoint. If the result is NO, then this logic step performs a logic loop until the result becomes YES. Once that occurs, a step 172 increases the fuser motor speed to full speed. Increasing the fuser motor speed to full speed also increases the belt rotation speed from half speed to full speed. This begins the interval T3 on FIG. 3.

Now that the system is in the lower power portion of the belt temperature warm-up mode, the next function is a step 174 that resets a specific timer to zero and starts to "count" the time. A decision step 180 determines if the elapsed time is greater than the desired time period of the low power heating portion. If the result is NO, then the logic flow loops back to the top of step 180 until the result becomes YES. Once this occurs, the control system has reached the end of the interval T3.

In steps 174 and 180, the timer that is "counting" the time is comparing that amount of elapsed time to the tabular values stored in a look-up table (LUT) for the low power heating portion time interval. As discussed above, this tabular value will be stored in a memory location (of the LUT) that was determined during the preheat mode, which is essentially based on the estimated amount of power that is being applied to the heater, due to variations in the AC power magnitude. The estimated heating power that has been calculated will be used to "point" to one of these stored tabular values, and a certain amount of interpolation would typically be required so that ranges of estimated heating power will be fitted to one of the tabular values.

If the timer's count value is equal or greater than the tabular elapsed time interval of the low power portion, the heater setpoint is reset to 190° C. to substantially prevent a belt temperature overshoot.

A decision step 190 now determines whether or not a print job is ready for printing. If the result is NO, then a step 194 resets the heater setpoint to the "idle" setting, to prevent the heater from overshooting its desired temperature. If the result is YES at step 190, the logic flow is directed to a step 192 in which the heater setpoint is reset to the "print" value. Printing can now safely occur because the fuser will be within its proper operating conditions.

All documents cited in the Background of the Invention and in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed, and the present invention may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) wherein said controller is configured to warm up said fuser belt before allowing said fuser assembly to perform a printing function, using the following routines:

(i) a preheat mode;

(ii) a first portion of a belt temperature warm-up mode;

(iii) a second portion of said belt temperature warm-up mode; and (iv) a tight belt temperature control mode;

(f) wherein during said preheat mode, said first signal energizes said heater such that the heater operates at less than full power, and said second signal prevents said fuser belt from rotating;

(g) wherein during said first portion of the belt temperature warm-up mode, said first signal energizes said heater such that the heater operates at full power, and said second signal rotates said fuser belt at a first rotational speed;

(h) wherein during said second portion of the belt temperature warm-up mode, said first signal energizes said heater such that the heater operates at less than full power, and said second signal rotates said fuser belt at a second rotational speed that is greater than said first rotational speed;

(i) wherein during said tight belt temperature control mode, said first signal energizes said heater such that said heater operates at a range of power less than said full power, and said second signal rotates said fuser belt at a third rotational speed for performing a fusing operation; and wherein said controller calculates a numeric value that determines a time interval for which said second portion of belt temperature warm-up mode will be in effect.

2. The belt fuser assembly of claim 1, wherein said second portion of belt temperature warm-up mode continues until a temperature of said fuser belt is within a predetermined operating temperature range.

3. The belt fuser assembly of claim 1, wherein during said second portion of belt temperature warm-up mode, said heater operates at a portion of full power that is determined by a routine that, during said preheat mode, determines the amount of electrical power that is being provided to said heater.

4. The belt fuser assembly of claim 3, further comprising a temperature sensor that is located proximal to said heater; and wherein said routine that determines the amount of electrical power that is being provided to said heater uses a temperature rise of said heater, as indicated by said temperature sensor, during said first portion of belt temperature warm-up mode.

5. The belt fuser assembly of claim 4, wherein the temperature rise of said heater is used to calculate the numeric value that determines the time interval for which the second portion of belt temperature warm-up mode will be in effect.

6. The belt fuser assembly of claim 5, wherein said calculated numeric value is used to point to a position of a look-up table that stores a plurality of time interval values, and said controller reads a time value from said look-up table position, which becomes said time interval for which the second portion of belt temperature warm-up mode will be in effect.

7. The belt fuser assembly of claim 3, wherein said routine that determines the amount of electrical power that is being provided to said heater performs a heating power estimate that varies with AC line voltage conditions, and said heating power estimate is used by said controller to calculate the numeric value that determines the time interval for which the second portion of belt temperature warm-up mode will be in effect.

8. The belt fuser assembly of claim 1, wherein said heater operates at about 30% of full power during said preheat mode.

9. The belt fuser assembly of claim 1, wherein said fuser belt rotates at about 40% of its printing speed during said first portion of belt temperature warm-up mode, and rotates at about 100% of its printing speed during said second portion of belt temperature warm-up mode.

10. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) a temperature sensor that is located proximal to said heater;

(f) wherein said controller is configured to warm up said fuser belt before allowing said fuser assembly to perform a printing function, using the following routines:

(i) a preheat mode;

(ii) a belt temperature warm-up mode; and (iii) a tight belt temperature control mode;

(g) wherein during said preheat mode, said first signal energizes said heater such that the heater operates at less than full power, in which said first signal operates using a first predetermined temperature setpoint value;

(h) wherein during said belt temperature warm-up mode, said first signal continues to energize said heater as desired by said controller, in which said first signal operates using a second predetermined temperature setpoint value, wherein said second predetermined temperature setpoint value is greater than said first predetermined temperature setpoint value; and (i) wherein during said tight belt temperature control mode, said first signal continues to energize said heater as desired by said controller, in which said first signal operates using a third predetermined temperature setpoint value, wherein said third predetermined temperature setpoint value is less than said second predetermined temperature setpoint value;

(j) wherein a numeric value of said third predetermined temperature setpoint value depends upon whether a print job is "ready" for printing at the end of said belt temperature warm-up mode, and:

(a) if a print job is "ready" for printing, the third predetermined temperature setpoint value is set to a fusing temperature; and (b) if a print job is not ready for printing, the third predetermined temperature setpoint value is set to an idle temperature.

11. The belt fuser assembly of claim 10, wherein said first predetermined temperature setpoint value is about 120° C., said second predetermined temperature setpoint value is about 240° C., and during printing said third predetermined temperature setpoint value is about 220° C.

12. The belt fuser assembly of claim 10, wherein said belt temperature warm-up mode has two portions, and during a first portion of the belt temperature warm-up mode, said second predetermined temperature setpoint value is about 240° C., and during a second portion of the belt temperature warm-up mode, said second predetermined temperature setpoint value is about 190° C., to substantially prevent a belt temperature overshoot.

13. The belt fuser assembly of claim 10, wherein said second signal provided by the controller controls a belt speed of said fuser belt.

14. The belt fuser assembly of claim 10, wherein during a first portion of said belt temperature warm-up mode:

(a) a routine of said controller calculates a time interval for which a second portion of the belt temperature warm-up mode will be in effect; and (b) said time interval calculation is based upon: (i) printing speed, (ii) heater setpoint, and (iii) a heating power estimate that varies with AC line voltage conditions.

15. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) a temperature sensor that is located proximal to said heater;

(f) wherein said controller is configured to warm up said fuser belt before allowing said fuser assembly to perform a printing function, using the following routines:

(i) check for a warm start mode by examining a temperature of said heater;

(ii) if in a cold start mode:

(A) set a heater power magnitude to less than full power;

(B) monitor said heater temperature until it reaches a first value; and (C) after reaching said first value, switch to said warm start mode; and (iii) if in warm start mode:

(A) turn on a motor for said fuser belt at about half speed;

(B) increase said heater power to full power;

(C) monitor said heater temperature until it reaches a second value;

(D) after reaching said second value, switch fuser belt to full speed;

(E) control said heater power at less than full power;

(F) determine a time interval for operating said heater power at less than full power;

(G) monitor elapsed time until it reaches said time interval; and (H) if print job is ready, control heater power to a printing power value;

(g) wherein during said cold start mode if said heater temperature is less than a third value, then said controller is configured to perform an excessive wattage check, in which a power estimation is performed.

16. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) wherein said controller is configured to warm up said fuser belt before allowing said fuser assembly to perform a printing function, using the following routines:

(i) a preheat mode;

(ii) a first portion of a belt temperature warm-up mode;

(iii) a second portion of said belt temperature warm-up mode; and (iv) a tight belt temperature control mode;

(f) wherein during said preheat mode, said first signal energizes said heater such that the heater operates at less than full power, and said second signal prevents said fuser belt from rotating;

(g) wherein during said first portion of the belt temperature warm-up mode, said first signal energizes said heater such that the heater operates at full power, and said second signal rotates said fuser belt at a first rotational speed;

(h) wherein during said second portion of the belt temperature warm-up mode, said first signal energizes said heater such that the heater operates at less than full power, and said second signal rotates said fuser belt at a second rotational speed that is greater than said first rotational speed; and (i) wherein said fuser belt rotates at about 40% of its printing speed during said first portion of belt temperature warm-up mode, and rotates at about 100% of its printing speed during said second portion of belt temperature warm-up mode.

17. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) a temperature sensor that is located proximal to said heater;

(f) wherein said controller is configured to warm up said fuser belt before allowing said fuser assembly to perform a printing function, using the following routines:

(i) a preheat mode;

(ii) a belt temperature warm-up mode; and (iii) a tight belt temperature control mode;

(g) wherein during said preheat mode, said first signal energizes said heater such that the heater operates at less than full power, in which said first signal operates using a first predetermined temperature setpoint value;

(h) wherein during said belt temperature warm-up mode, said first signal continues to energize said heater as desired by said controller, in which said first signal operates using a second predetermined temperature setpoint value, wherein said second predetermined temperature setpoint value is greater than said first predetermined temperature setpoint value;

(i) wherein during said tight belt temperature control mode, said first signal continues to energize said heater as desired by said controller, in which said first signal operates using a third predetermined temperature setpoint value, wherein said third predetermined temperature setpoint value is less than said second predetermined temperature setpoint value; and (j) wherein said first predetermined temperature setpoint value is about 120° C., said second predetermined temperature setpoint value is about 240° C., and during printing said third predetermined temperature setpoint value is about 220° C.

18. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) a temperature sensor that is located proximal to said heater;

(f) wherein said controller is configured to warm up said fuser belt before allowing said fuser assembly to perform a printing function, using the following routines:

(i) a preheat mode;

(ii) a belt temperature warm-up mode; and (iii) a tight belt temperature control mode;

(g) wherein during said preheat mode, said first signal energizes said heater such that the heater operates at less than full power, in which said first signal operates using a first predetermined temperature setpoint value;

(h) wherein during said belt temperature warm-up mode, said first signal continues to energize said heater as desired by said controller, in which said first signal operates using a second predetermined temperature setpoint value, wherein said second predetermined temperature setpoint value is greater than said first predetermined temperature setpoint value;

(i) wherein during said tight belt temperature control mode, said first signal continues to energize said heater as desired by said controller, in which said first signal operates using a third predetermined temperature setpoint value, wherein said third predetermined temperature setpoint value is less than said second predetermined temperature setpoint value; and (j) wherein said belt temperature warm-up mode has two portions, and during a first portion of the belt temperature warm-up mode, said second predetermined temperature setpoint value is about 240° C., and during a second portion of the belt temperature warm-up mode, said second predetermined temperature setpoint value is about 190° C., to substantially prevent a belt temperature overshoot.

19. A belt fuser assembly for an electrophotographic printer, said belt fuser assembly comprising:

(a) an endless fuser belt that rotates;

(b) a heater for heating said fuser belt;

(c) a backup member that engages said fuser belt and defines a fusing nip with said fuser belt;

(d) a controller that provides a first signal for energizing said heater, and provides a second signal for rotating said fuser belt;

(e) a temperature sensor that is located proximal to said heater;

(f) wherein said controller is configured to warm up said fuser belt before allowing said fuser assembly to perform a printing function, using the following routines:

(i) a preheat mode;

(ii) a belt temperature warm-up mode; and (iii) a tight belt temperature control mode;

(g) wherein during said preheat mode, said first signal energizes said heater such that the heater operates at less than full power, in which said first signal operates using a first predetermined temperature setpoint value;

(h) wherein during said belt temperature warm-up mode, said first signal continues to energize said heater as desired by said controller, in which said first signal operates using a second predetermined temperature setpoint value, wherein said second predetermined temperature setpoint value is greater than said first predetermined temperature setpoint value;

(i) wherein during said tight belt temperature control mode, said first signal continues to energize said heater as desired by said controller, in which said first signal operates using a third predetermined temperature setpoint value, wherein said third predetermined temperature setpoint value is less than said second predetermined temperature setpoint value;

(j) wherein said second signal provided by the controller controls a belt speed of said fuser belt;

(j) wherein during a first portion of said belt temperature warm-up mode: (a) a routine of said controller calculates a time interval for which a second portion of the belt temperature warm-up mode will be in effect; and (b) said time interval calculation is based upon: (i) printing speed, (ii) heater setpoint, and (iii) a heating power estimate that varies with AC line voltage conditions.

* * * * *